US005636587A

United States Patent [19]

Klimowicz

[11] Patent Number: 5,636,587

[45] Date of Patent: Jun. 10, 1997

[54] SUPPORT APPARATUS FOR A SMALL WATERCRAFT ADAPTED TO BE SECURED TO A CARRIER ON A LARGE WATERCRAFT AND METHOD OF LOADING THE SMALL WATERCRAFT

[76] Inventor: Jerome R. Klimowicz, 3827 W. LeGrande Blvd., Mequon, Wis. 53092

[21] Appl. No.: 304,096

[22] Filed: Sep. 9, 1994

[51] Int. Cl.[6] ..... B63B 23/02

[52] U.S. Cl. ..... 114/259; 114/365

[58] Field of Search ..... 114/230, 258, 114/259, 260, 365, 366, 368, 375, 270, 345, 364, 362; 405/1–3; 280/414.1; 440/38

[56] References Cited

U.S. PATENT DOCUMENTS

| | | | |
|---|---|---|---|
| 1,064,472 | 6/1913 | Haas | 114/259 |
| 2,370,916 | 3/1945 | Reedy, Sr. | 114/259 |
| 2,398,274 | 4/1946 | Albert | 114/365 |
| 3,805,722 | 4/1974 | Melchert, Jr. et al. | 114/343 |
| 4,103,926 | 8/1978 | Johnston et al. | 280/414.1 |
| 4,878,450 | 11/1989 | Schmidt, Jr. | 114/259 |
| 4,964,358 | 10/1990 | Sandrow | 114/365 |
| 5,076,191 | 12/1991 | Madore | 114/270 |
| 5,133,275 | 7/1992 | Maurizio | 114/259 |
| 5,167,550 | 12/1992 | Nielsen | 440/84 |
| 5,184,913 | 2/1993 | Meriwether | 280/414.1 |
| 5,282,437 | 2/1994 | Avillez de Basto | 114/345 |

*Primary Examiner*—Edwin L. Swinehart
*Attorney, Agent, or Firm*—Andrus, Sceales, Starke & Sawall

[57] ABSTRACT

A watercraft carrier is secured to a large watercraft having a transom. The carrier includes a mounting structure secured to the transom and a platform structure including a pair of laterally spaced platform units extending parallel to the transom and substantially in a horizontal plane above the water line of the large watercraft. The platform units each similarly include a support bar. A plurality of rollers are secured in longitudinally spaced relation along the bar. The rollers are formed of a resilient material or resiliently loaded to conform to the bottom of the personal watercraft. The personal watercraft has an inclined bow or front end and is self-propelled causing it to move upwardly out of the water onto the platform units in a highly safe and reliable procedure. Power is applied to the personal watercraft to move the hull upwardly on the entrance end and then the power is increased to cause the watercraft to move rapidly onto and in essence pop out of the water onto the platform units. The weight of the watercraft provides a firm support of the personal watercraft on the platform structure. Auxiliary securement lines may be interconnected between the personal watercraft and the larger watercraft.

27 Claims, 5 Drawing Sheets

SUPPORT APPARATUS FOR A SMALL WATERCRAFT ADAPTED TO BE SECURED TO A CARRIER ON A LARGE WATERCRAFT AND METHOD OF LOADING THE SMALL WATERCRAFT

BACKGROUND OF THE INVENTION

This invention relates to a small watercraft support apparatus for attachment to a much larger watercraft for supporting of a small powered watercraft.

Relatively large recreational watercrafts and the like often carry a dinghy for moving personnel or items with respect to spaced land or other watercrafts. A conventional dinghy generally includes an inflatable frame structure with manual powering unit, a small outboard motor or the like. Small row boats and sail boats may also be used as dinghies. The inflatable dinghies are relatively light weight devices and can be readily manually secured and raised into a carried position on the larger watercraft. Where a relatively large dinghy, such as a large row boat is used, some form of a powered lift mechanism is generally provided which lowers into engagement with the dinghy and then raised, with a powered or manually operated lift mechanism. Typical systems are shown in U.S. Pat. Nos. 4,878,450 which issued on Nov. 7, 1989 and U.S. Pat. No. 5,332,275 which issued Jul. 28, 1992. The '450 and '275 patents disclosed support structures for securing of the dinghy to a larger watercraft for releasably securing of the dinghy to the larger watercraft.

Although such dinghies have been widely used for many years, development of personal watercraft used for recreational and limited transport over a body of water provides a device now used as a dinghy on other watercraft. The personal watercraft generally consists of a hard plastic body or the like with motor driven jets for propelling of the watercraft are widely used for recreational purposes. Such personal watercraft devices have also become popular for use in place of a conventional dinghy.

A personal watercraft is a relatively heavy device and raising and placement on large pleasure watercrafts requires special powered devices for moving the device into and from a loaded position. Such systems are relatively costly, may be difficult to operate and tend to limit the application of a personal watercraft or similar powered watercraft for use as a dinghy and an auxiliary recreational vehicle or the like.

The small personal watercraft is a well known unit, having been developed from the original jet ski. Personal watercraft has developed into a recreational vehicle as well as a useful transportation vehicle for water travel, with the operator and passenger sitting on the watercraft. Although the present invention has been particularly developed with the use of personal watercraft, its application to other small watercraft will be obvious from the disclosure of the preferred application and embodiment.

There is therefore a significant need for a support structure or carrier which permits the easy loading and unloading of a personal watercraft or similar powered auxiliary watercraft while retaining secure support of the auxiliary watercraft in place for transport but the larger watercraft.

SUMMARY OF THE PRESENT INVENTION

The present invention is particularly directed to a carrier apparatus including a platform structure adapted to be secured to the exterior of a larger watercraft, with the platform structure exposed and located for direct driving of the small watercraft such as a personal watercraft onto the platform structure, and placement in a reliable transport position. The platform structure permits the ready discharge of the small watercraft for use separate from the large carrier watercraft. The present invention has been particularly used with a personal watercraft, and is described in the connection therewith for purposes of description of the present novel system, but is not limited to such watercraft.

Generally, in accordance with the present invention, a platform structure is secured in fixed relation to the large watercraft. The platform structure is oriented with respect to the water level of the large watercraft to permit the alignment of the personal watercraft with the platform structure and by controlled powering of the personal watercraft directly driving the jet ski onto the platform structure. The personal watercraft is held in upwardly spaced relation to the water level on the platform structure, thereby providing a significantly improved and effective support of the jet ski for transport on the large watercraft. The personal watercraft is readily removed by manually pushing or pulling the same from the platform unit, with or without an auxiliary unit, such as a winch or block-and-tackle unit, or the like or by providing a powered means for moving the small watercraft off the platform unit into the water. An auxiliary assist or powered system may also be used in the event the propulsion system of the watercraft is inoperative or even as a standard loading or unloading system, within the broadest teaching of the present invention.

In accordance with a practical and particularly unique embodiment of the present invention, the watercraft carrier includes a mounting structure secured to an exterior support wall of the large watercraft, and preferably the transom, with a pair of laterally spaced platform units extending parallel to the exterior support wall of the large watercraft. The assembly may be mounted with the platform units at a slight inclined orientation with respect to the water level of the larger watercraft, but are preferably located in a substantially horizontal plane parallel to the water surface. The platform units are laterally spaced in accordance with the width of the personal watercraft and located to engage the bottom of the hull and on opposite sides of the vertical center thereof. The inventor has discovered that the personal watercraft can be aligned with the platform units, and power applied to the personal watercraft causing it to move upwardly out of the water onto the platform units in a highly safe and reliable procedure. The weight of the watercraft provides a firm support of the personal watercraft on the platform structure. In addition, auxiliary attachments, such as flexible lines and the like, can be interconnected between the personal watercraft and the large watercraft to further insure the position.

In a practical implementation of the present invention, the platform structure is secured to the aft end or transom of a power watercraft. Where the large watercraft has an aft accommodation deck such as a swimming deck, the platform structure is secured to the transom beneath the deck. The mount structure projects beneath the deck and outwardly therefrom. The mount structure in a preferred system consists of an upper support member and a bottom support member with the bottom support member inclined downwardly to a transom attachment to provide a generally triangular support structure. Both support members are elongated rigid members of metal or other similar high strength material. The bottom support member structure may be pivotally interconnected to the transom and the outer end of the upper support member for adjustment to the depth and angle of the transom of the large watercraft. The platform structure further includes the pair of laterally spaced platform units secured to the upper support members. Each platform unit includes a support element such as a rigid elongated rail which is preferably provided with spaced roller members or the like secured in spaced relation on the support element to lower the frictional forces between the underside of the personal watercraft and the platform units. The platform units are secured to the upper support members with the platform units and particularly the rollers or other supporting surfaces located above the deck and thus above the water line. The inclined front portion of the bottom hull of the personal watercraft moves into overlying relationship to the entrance end of the platform units, and when power is applied to the personal watercraft, it moves rapidly onto and in essence pops out of the water onto the platform units in a very reliable supported assembly on the platform structure. The personal watercraft thus moves upwardly and forwardly, and when the center of gravity is sufficiently forward, the watercraft moves downwardly onto the platform units.

The under structure can be readily formed as a pair of laterally spaced similar triangularly shaped supports including tubular metal rods, preferably of a rectangular cross-section. The upper member is secured directly to the transom of the watercraft by a suitable bracket, with the member projecting substantially horizontally outwardly therefrom. The lower member also includes a similar tubular metal or other high strength material rod, the lower end of which is connected to a transom mounting bracket and the outer end of which is mounted by a bracket unit to the outer end of the upper tubular metal rod. The platform units each similarly may include a support bar adapted to extend over the upper tubular rods of the support structure. A plurality of paired rollers are secured in longitudinally spaced relation along the platform bars, with each pair having a roller mounted to each side of the platform bar. Mounting brackets are secured to the upper support rods and to the platform bars to support the rollers in place and with the rollers inclined inwardly to generally conform to the bottom of the personal watercraft.

Supporting straps may be secured to the support structure of the large watercraft and to the platform and/or the personal watercraft in the transport position to secure the personal watercraft to the platform structure, particularly in heavy seas and the like.

The inventor has discovered that the structure has found significance acceptance and interest by owners of large watercrafts. The present invention thus provides a relatively inexpensive, reliable and highly effective storage carrier for carrying of a powered personal watercraft or other similar watercraft structure for large recreational watercrafts and the like.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE ILLUSTRATED EMBODIMENT

Figure 1:
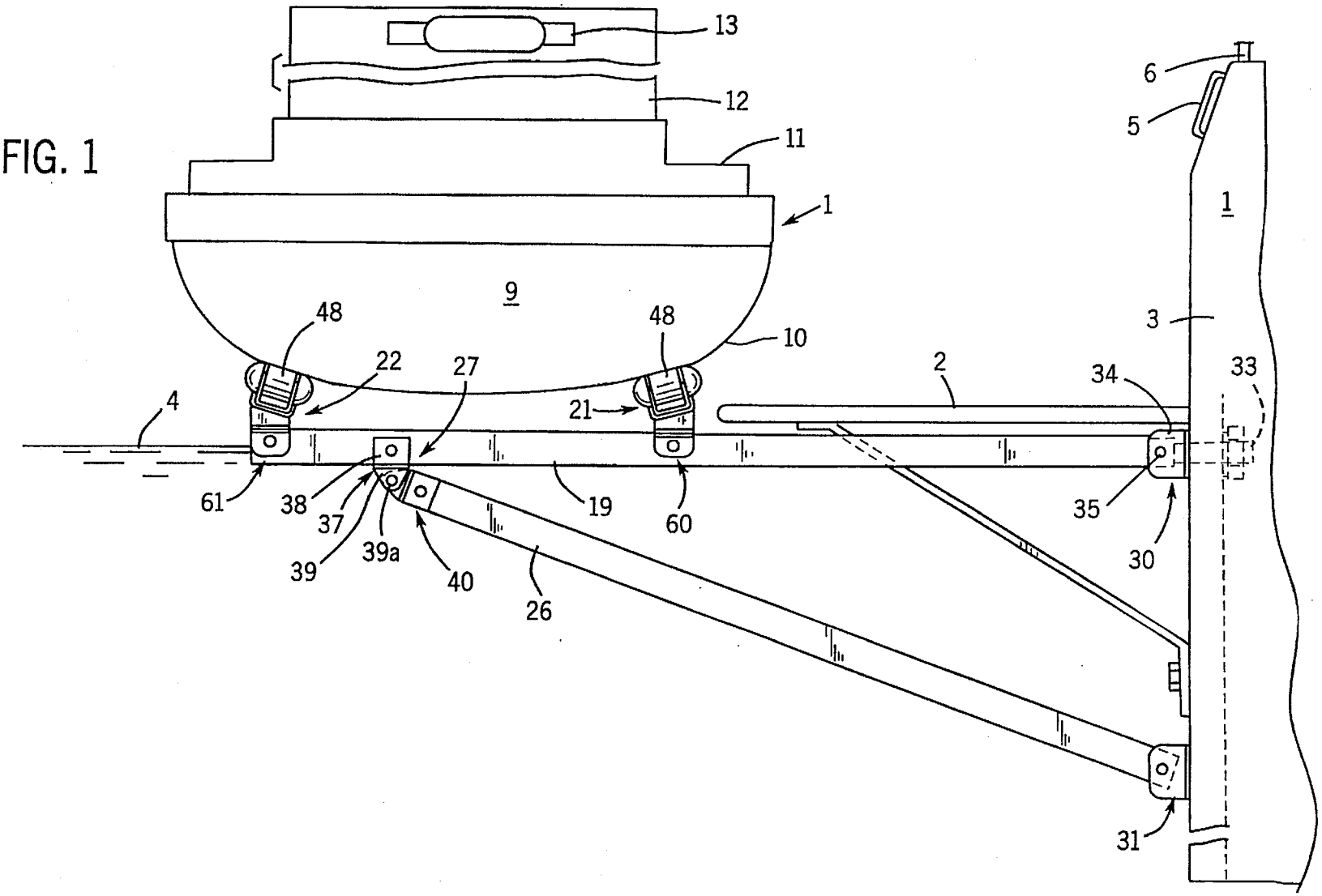
FIG. 1 is a fragmentary side view illustrating a personal watercraft mounted to a carrier platform on the aft end of a large recreational watercraft.
Figure 2:
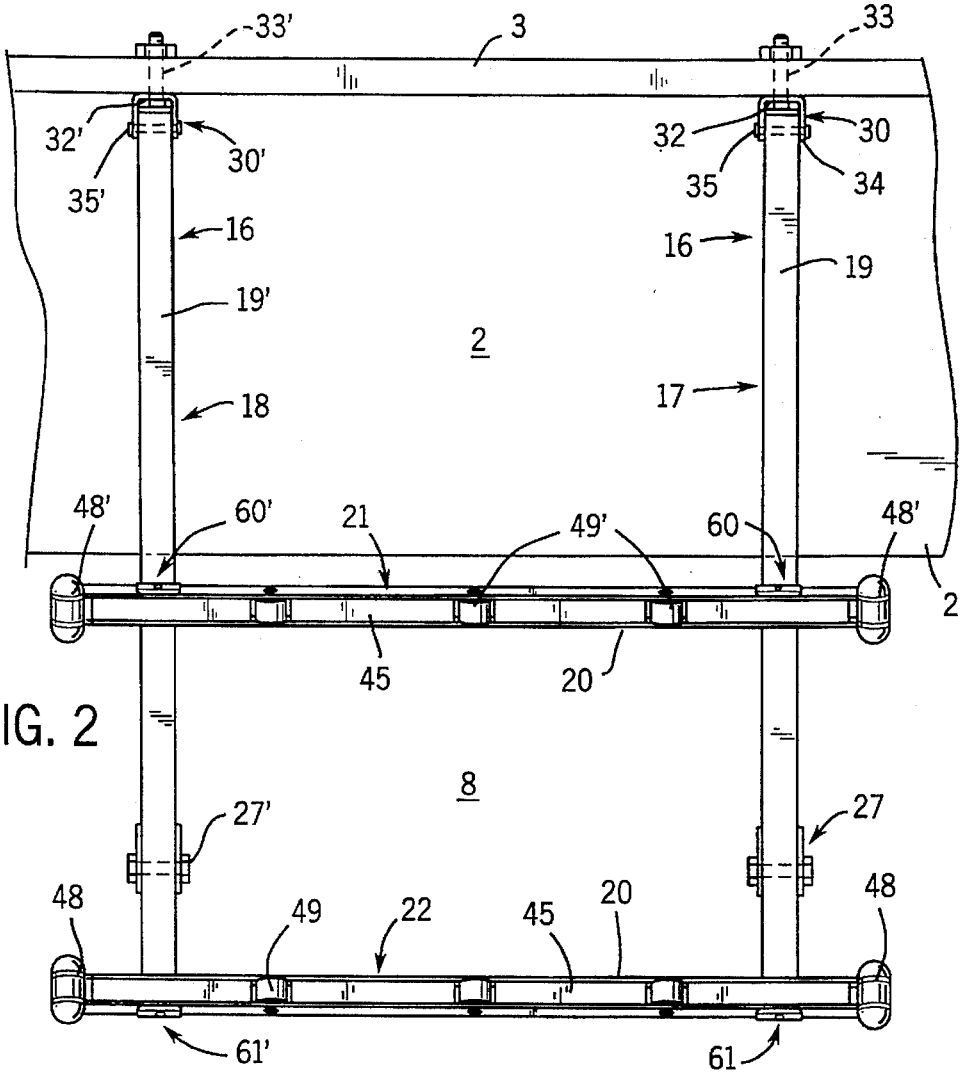
FIG. 2 is a top view of the platform with the ski watercraft removed.
Figure 3:
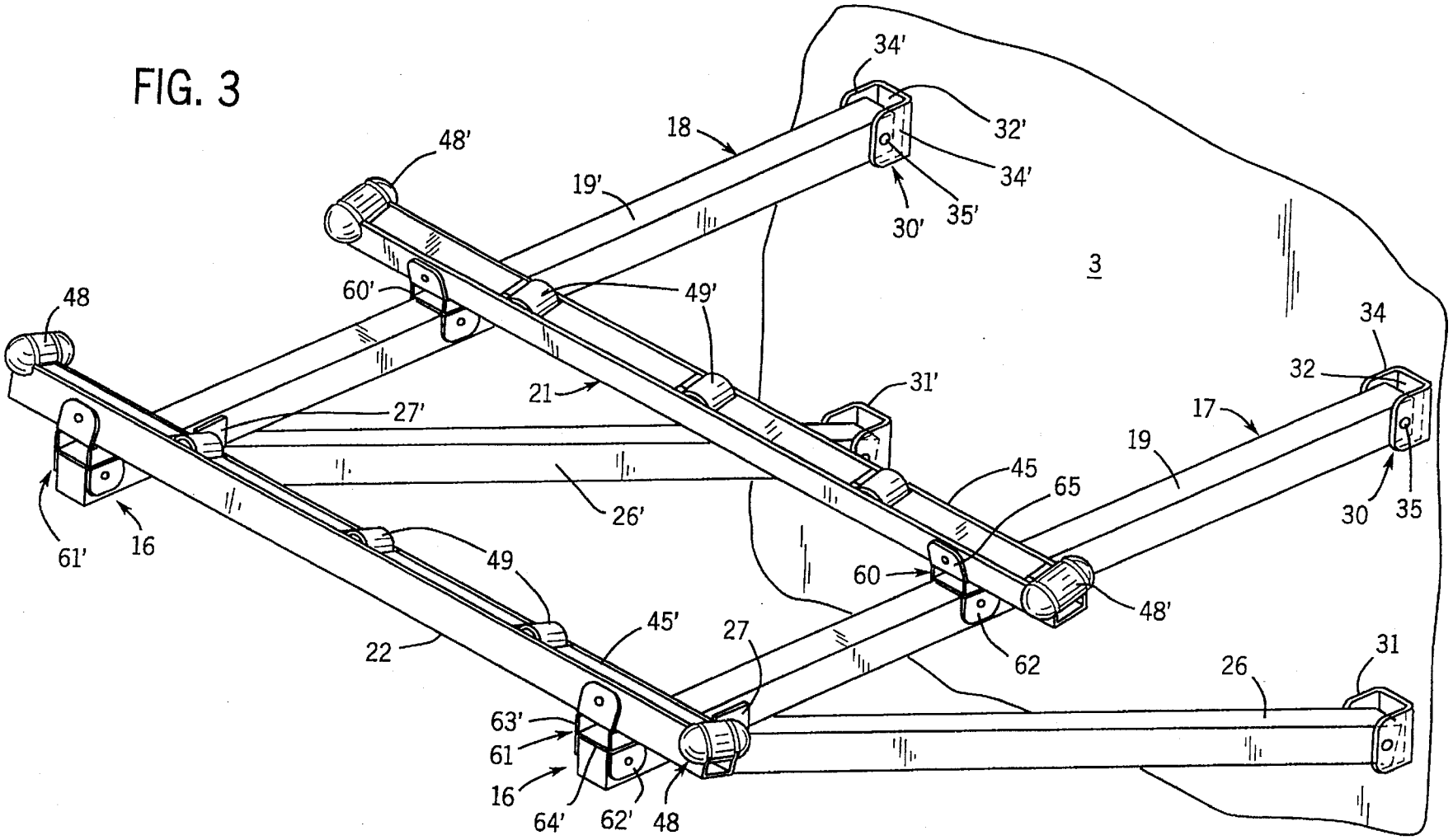
FIG. 3 is a pictorial view of the platform.

Referring to the drawings and particularly to FIGS. 1–3, the aft end 1 of a typically large recreational power watercraft is diagrammatically illustrated including a rear deck 2 secured to and projecting outwardly from the transom 3. The deck 2 extends substantially across the complete width of the transom 3 and projects outwardly therefrom a sufficient distance to allow a person or persons to stand on the deck for entering or leaving the watercraft and the like. The platform or deck 2 is located slightly above the water line 4 of the watercraft with a ladder structure 5 shown secured to the transom for convenience of entering and leaving the watercraft. In addition, a rail structure 6 is normally provided at the top of the transom 3 for use by the person adjacent the transom.

In accordance with the illustrated embodiment of the present invention, a personal watercraft carrier and platform 8 is secured to the transom 3 for supporting of a powered personal watercraft 9 immediately rearwardly of the deck 2. The platform 8 is shown located to the one side of the large watercraft 1 which is shown having a greater width than the length of the personal watercraft 9. In accordance with conventional construction, the personal watercraft 9 includes a hull 10 with an aft seat 11 and a forward enclosure 12 for supporting handle structure 13. The user sits on the seat 11 and turns the handle 13 for turning the water jet propulsion device, not shown. The handle structure 13 generally includes a control device, such as a thumb operated throttle control for controlling the speed of the personal watercraft by controlling the motor, not shown, of the motor jet drive system. The bottom of the personal watercraft hull 10 has a more or less conventional bottom wall configuration with an inclined forward end 14 merging with the bottom and trailing end 15. The bottom hull structure is laterally concave and relatively longitudinally flat from the front end 14.

The illustrated platform 8 is constructed with an under support structure 16 secured to the watercraft transom 3 and is extended rearwardly of the deck 2. The illustrated support structure 16 includes a pair of similar laterally spaced support assemblies or units 17 and 18 secured to the transom 3 immediately beneath the deck 2. Each unit 17 and 18 include an upper generally horizontal arm 19 and 19' extending outwardly from beneath the deck 2. A platform structure 20 is secured to the outer end of the support units 17 and 18 and is located to define a support surface at or above the level of the deck 2. The platform structure 20 consists of a pair of laterally spaced similarly constructed platform units 21 and 22 which extend parallel to the transom 3. The platform units 21 and 22 are laterally spaced to underlie and engage the bottom wall of the personal watercraft hull 10 in the storage or transport position, generally in a horizontal plane and in the manner of a watercraft trailer. The platform units 21 and 22 are preferably formed to establish a relatively low friction support of the personal watercraft 9 to permit the direct riding of the personal watercraft 9 upwardly onto the platform units 21 and 22 from the water 4 while still permitting the ready manual pushing of the personal watercraft 9 from the platform units into the water, with a jet ski operator and rider in controlled position on the personal watercraft. Thus, with the personal watercraft 9 in the carried position, an operator may mount the personal watercraft. Another party can then readily push the personal watercraft 9 downwardly on the platform units toward and into the water. Raising of the front end while pushing on the watercraft tends to facilitate the transfer into the water. Once the trailing end of the personal watercraft 9 engages the water, the floating characteristics will further ease the removal of the personal watercraft from the carrier 8 and therefore the large watercraft.

Figure 8:
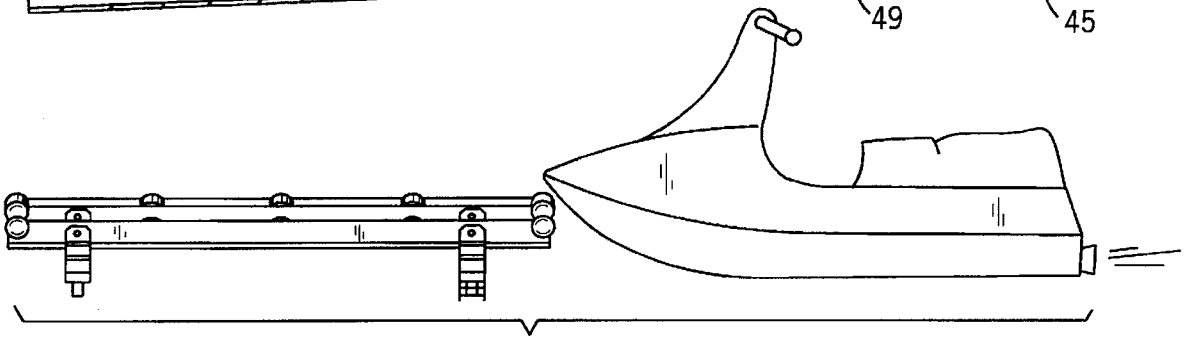
FIGS. 8–10 illustrate the sequential movement of the personal watercraft in loading thereof onto the platform for carrying on the larger watercraft.
Figure 10:
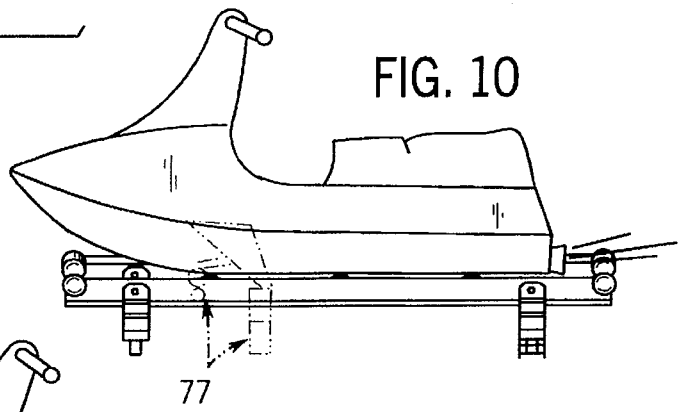
Figure 9:
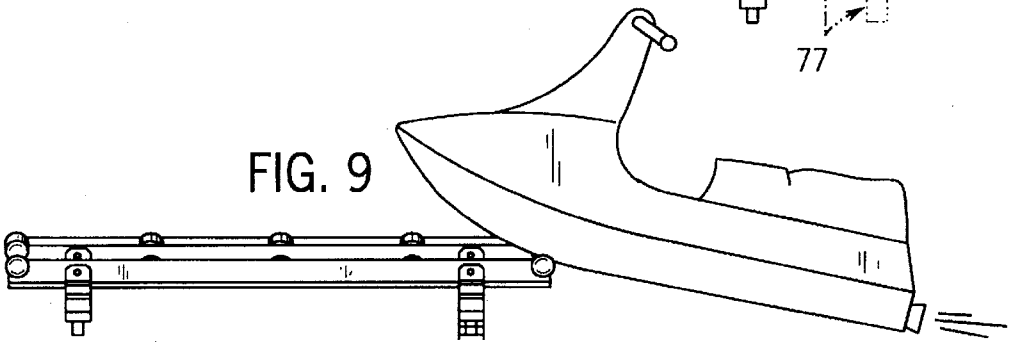

Conversely, as shown in FIGS. 8–10, when it is desired to load the personal watercraft 9 onto the platform 8, it is merely necessary to align the front end 14 with the platform units 21 and 22 as shown in FIG. 8, with the operator then applying low power to move the personal watercraft 9 onto the entrance ends of platform units 21 and 22 as shown in FIG. 9 and finally provide a short surge of power to pop the personal watercraft 9 from the water onto the platform units 21 and 22 as shown in FIG. 10. The personal watercraft 9 is then located in the transport position. In the initial alignment on entry, an assisting party on the deck may lift the front of the watercraft for movement onto the entrance end of the platform. Additional securement lines 23–24 can be interconnected between the carrier 8 and the larger watercraft 1 to more securely lock the personal watercraft 9 in location for transport on the large watercraft.

Further, although shown in FIGS. 8–10 with the personal watercraft in the several sequential locations in moving onto the platform, the system appears to operate with the center of gravity moving upwardly and forwardly until the relationship to the platform results in the front end dropping downwardly, with the boat pivoting on the rollers into a generally horizontal position and with the inertia in the system moving the boat forwardly onto the platform. If it is not fully in position, the watercraft can be readily manually moved into the desired position.

More particularly, the structural mount assembly 16 includes the pair of generally similar triangularly shaped support units 17 and 18, each of which is substantially similarly constructed in the illustrated embodiment of the invention. Referring to the unit 18 shown to the right in FIG. 3, the detailed description of its structure is given. The elements of the second unit 18 are identified with corresponding primed numbers for simplicity and clarity of explanation.

Referring particularly to FIGS. 1–5, the support unit 17 is a generally triangular configured assembly with the base defined by the transom 3. The unit 17 includes the upper generally horizontal top support member 19 and a bottom angled support member 26 which extends from the transom 3 upwardly into a connector unit 27 at the outermost end of the member 19. Pivotal connector 27 permits adjusting the angle of the lower member 26 with respect to the transom 3 for adapting of the mount unit 17 to different depths of large watercraft transoms. The two support units 17 and 18 and particularly elements 19 and 19' thus define a pair of horizontal support members located generally in a common plane. The support units 17 and 18 are spaced from each other to provide a firm and stable support of the forward and aft end of the ski watercraft.

Figure 5:
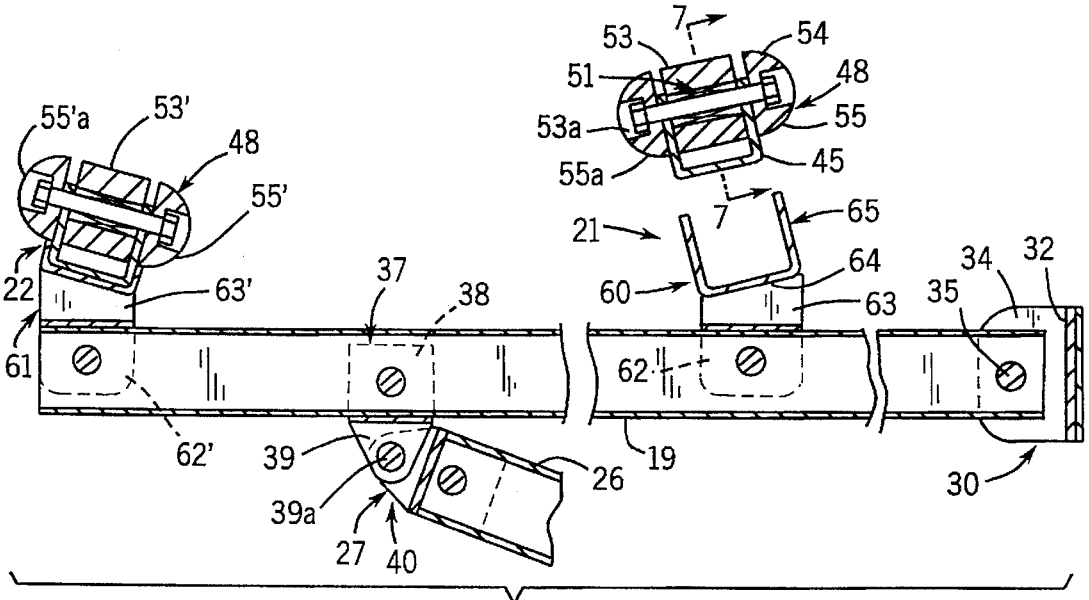
FIG. 5 is an enlarged fragmentary and sectional view of a portion of the platform.
Figure 4:
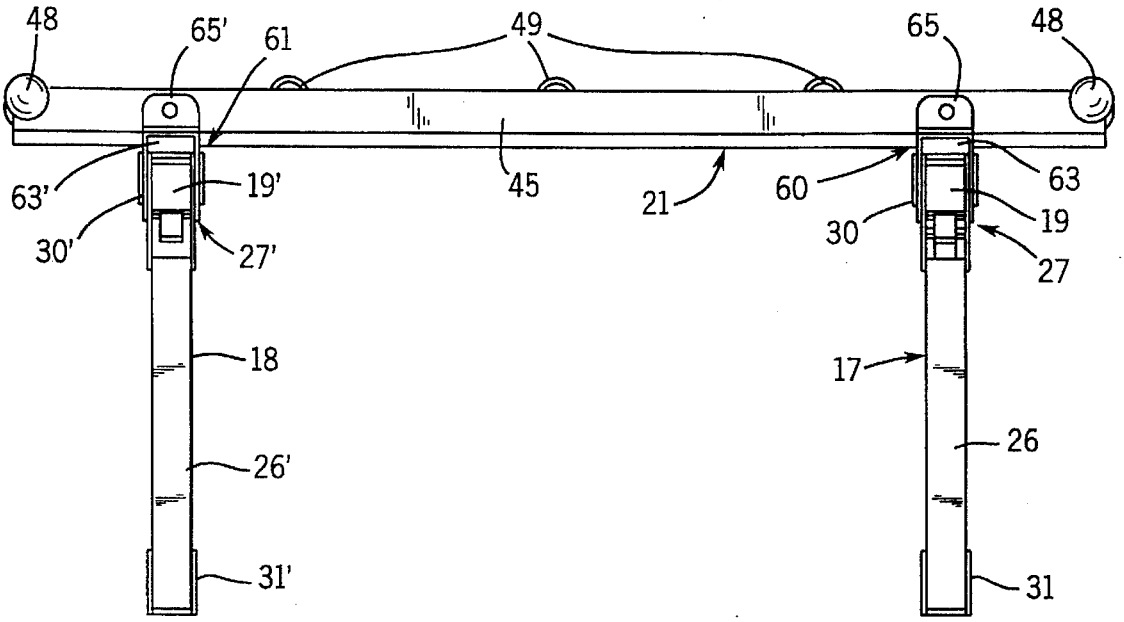
FIG. 4 is a rear view of the platform.

As most clearly illustrated in FIGS. 1, 4 and 5, the illustrated embodiment has the mount unit 17 and particularly arms 19 and 26 are secured to the watercraft transom 3 by upper and lower brackets 30 and 31.

The upper bracket 30 is shown as a U-shaped bracket having a base portion 32 secured to the transom 3 as by bolts 33, with sidewalls 34 projecting outwardly therefrom. Bolt 33 project through bolt openings in the base and the transom 3 for firmly anchoring of the member 25 to the transom 3. The top support member 19 is shown as a tubular member formed of a rigid metal or the like. The tubular member has a rectangular cross-section and extends into the opening of bracket sidewalls 34 and projects outwardly therefrom. A bolt 35 secures the member 19 to the bracket sidewalls 34.

The connector unit 27 is secured adjacent the outer end of the top support member 19 and the outer end of the lower support member 26. The connector unit 27 includes a bracket 37 rigidly affixed to the outer end of the support member 19. Bracket 37 has a generally inverted U-shaped base 38 bolted or otherwise secured underside of the top support member 19. A connector plate 39 extends from base 38 and is connected by a pivot bolt **39*a* to a corresponding bracket 40 secured to the outer end of the lower support member 26**.

The transom end of the lower support member 26 is secured to the transom end by the bracket 31. Bracket 31 is generally a U-shaped member corresponding to bracket 30, and is similarly bolted directly to the transom 3. The support member 26 projects into the bracket 31 and is bolted thereto.

The platform units 21 and 22 are longitudinally spaced along the upper or top support members 19 and 19' and again are generally similarly constructed. The platform units 21 and 22 are shown canted inwardly toward each other; defining a shallow V-shaped configuration substantially in accordance with the configuration of the bottom wall of the jet ski hull 10, as shown in FIG. 1. Each of the platform units 21 and 22 is otherwise similarly constructed and the unit 21 is described in detail with the opposite unit 22 having its elements identified by corresponding primed numbers.

Figure 6:
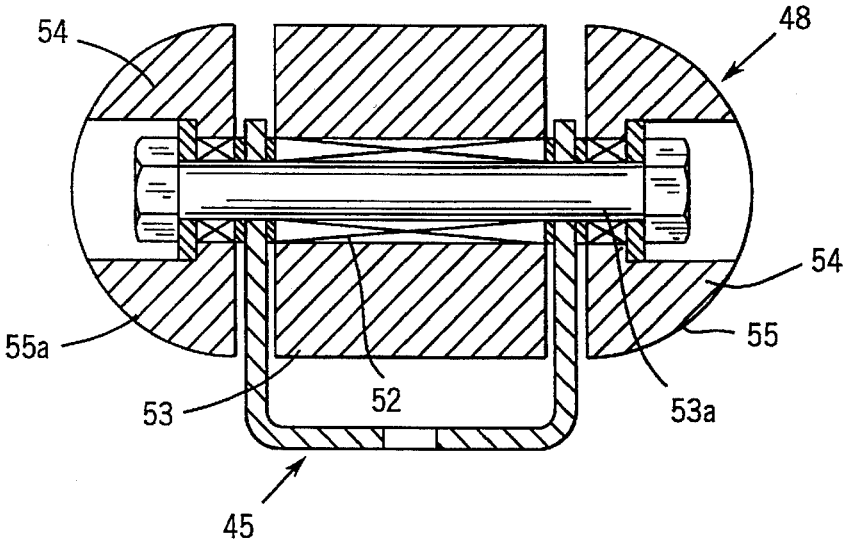
FIG. 6 is an enlarged view of a roller structure.
Figure 7:
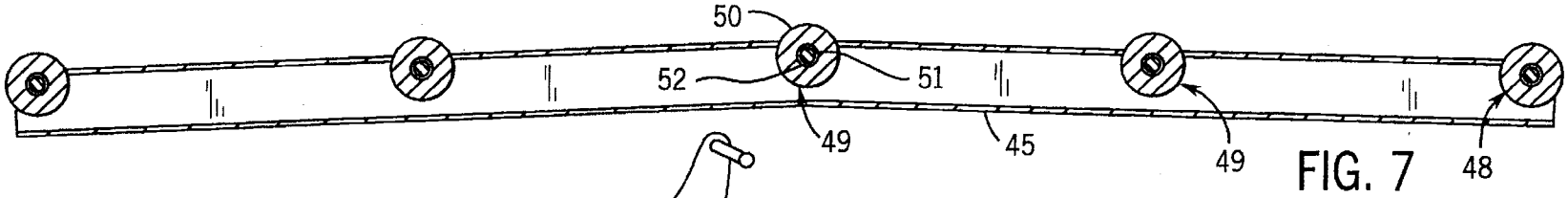
FIG. 7 is a sectional view taken on line 7—7 of FIG. 5.

Referring particularly to the platform unit 22 as shown in FIGS. 1–5, the unit 22 includes a rigid mounting bar 45 shown as a generally rectangular tubular member of the same material and cross section as the support members of structure 16. The bar 45 extends across and is secured to the two upper support members 19 and 19' by upstanding brackets 46 and 47. A plurality of roller units are secured in longitudinally spaced relation along the platform 45 including special end roller units 48 and intermediate roller units 49. As shown in FIG. 7, each intermediate roller units 49 include a single roller 50 rotatably mounted to the bar 45. An axle 51 is secured projecting through and from the opposite sides of the roller and the sidewalls of bar 45. Axle 51 is shown as a bolt member having a low friction sleeve bearing 52 supporting the roller. As shown in FIG. 6, the end roller units 48 include a roller 53 similarly located on an axle **53*a* within bar 45 and outer end rollers 54. The end rollers 54 have semi-spherical outer surfaces 55 and are rotatably secured abutting the outer walls of bar 45 by axle 53*a*. The top surfaces of the roller units 48 and 49 are located above the level of the platform bar 45 and provides a low friction rolling support for the movement of the personal watercraft and from the platform unit 21. The substantial horizontal location of the platform unit 21, however, provides for reliable support of the personal watercraft in the carrier or transport position. The rollers 50 and 53 preferably extend outwardly of the rail or bar 45 about ½ to 1 inch. Further, the rollers 50 and 53 are preferably constructed and arranged to provide a resilient support to the watercraft 9. Thus, the bottom of the watercraft hull 10 may vary somewhat from substantially flat wall surfaces and orientations. The roller, for example, may be formed of a suitable material with an appropriate softness or a compressive mounting provided such that the roller support creates an optimal engagement with the bottom wall configuration of the auxiliary watercraft 9**.

The illustrated roller bearing structures have provided a satisfactory and practical implementation of the present invention. The construction of such structure however should include consideration to maintain minimal frictional forces such as to provide for the most convenient movement of the personal watercraft onto and from the platform in an optimal system. Thus, various improved bearing materials and structures are available for further consideration in the providing of a satisfactory roller structures.

Thus, the unloading and loading of the personal watercraft may be readily provided by manual unloading while the loading is readily provided by self-powered powering of the personal watercraft on the platform 8, as shown in FIGS. 8–10. As more fully discussed hereinafter, powered or manual assist devices may be used for or during the loading and unloading of the personal watercraft.

The exact location of the entrance of the platform structure with respect to the water level of the boat is not critical but should be oriented to avoid the location of the platform unit within the water during movement on the water. Where a deck 2 is provided, it is generally located to be above the water level under normal watercraft movement. Thus, by locating of the platform unit 8 somewhat above the deck, a satisfactory orientation is obtained. Thus, in a practical application, the platform has been located approximately 4 to 6 inches above a deck. However, the system operated well even with the platform structure approximately 8 to 12 inches above the water line level. Thus, the top rails of the triangular support members can be located at the approximate water line with the bracket assemblies locating of the platform unit above the deck and in appropriate orientation with respect to the water line.

Also, in the orientation of the carrier, consideration should be given to the wake developed by the large watercraft. Thus, such large watercraft generally creates a somewhat concave hollow wake following the stern of the boat. The width of the wake is somewhat smaller than the width of the boat stern and in order to maintain the desired orientation and location of the platform, consideration should be given to the characteristic of the wake to maintain the platform out of the water during movement. Thus, the platform should be moved inwardly or upwardly as necessary, to insure complete separation from the wake in the body of water during the movement of the large watercraft for optimal operation.

Further, although the illustrated embodiment shows the support structure or platform falling within the width of the large watercraft, such is not necessarily critical. Thus, even on large watercraft having a stern which has a width less than the width of a powered personal watercraft, a platform structure as disclosed may be used. Special consideration, of course, must be given by the operator when docking of the boat to a dock, another watercraft or the like. The construction which limits it within the confines of the large boat provides a safer and more readily manipulated assembly.

The platform units 21 and 22 are similarly secured to the top members 25 and 25' of the support structures 17 and 18. Reference is made to the unit 21, as shown in FIG. 5, for a detailed description. Similar spaced connector units 60 and 61 are secured to the top support member 19. Referring particularly to the connector unit 60, an inverted U-shaped support member 62 is bolted to the top member 19. An upper box-like member 63 is integrally formed to member 62 and projects upwardly to an outer inclined wall 64. A U-shaped bracket 65 is secured to the inclined wall 64 with sidewalls spaced to receive the platform bar 45. A bolt 66 extends through openings in the telescoped member bar 45 and sidewalls of bracket 65 to support the platform unit 21 for canted location with respect to the opposite platform unit 22. The units can then be reoriented to accommodate the canted or inclined portions of the bottom of the jet ski unit 9.

Although shown in FIG. 5 with the bracket unit tailored to support the roller unit in a particular inclined or canted position, any other systems can be provided for varying of the orientation of the roller assemblies or linear supports relative to each other. Thus, the particular orientation desired may vary between a horizontal plane to various inclined orientations. One example of an adjustable system is shown in FIG. 11.

Figure 11:
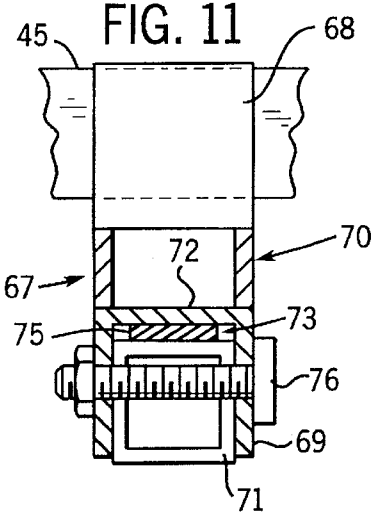
FIG. 11 illustrates an alternate bracket assembly for platform orientation as shown in FIG. 5.

Referring to FIG. 11, a bracket assembly 67 is shown with a similar arrangement to that of FIG. 5. Offset U-shaped saddle members 68 and 69 are secured in line with each other and with riser member 70 therebetween. The rail or bar member 69 is secured to the bar 71 with its base 72 raised slightly above the bar as at 73. This permits tilting of the bracket assembly relative to the rail, and thereby setting the inclination of the roller unit 74. The roller unit 74 unit can then be adjusted to any particular boat structure from the flat horizontal position to a desired inclined position. After appropriate orientation, the assembly is locked in place preferably with the insertion of the filler insert or member 75 between the bar and the base of the bracket assembly, with the bolt 76 tightened to secure the assembly in place. The total assembly the provides a reliable and effective adjustable inclined or flat orientation for optimal support of the watercraft.

The particular construction of the understructure of the platform units 21 and 22 is shown in a practical implementation but may of course take any other form or construction which will provide a physical support sufficient to support a personal watercraft or the like. The structure should of course minimize the weight attached to the watercraft and provide a long life and rugged support structure which can be used in the marine environment.

The illustrated support allows the pivotal adjustment of a plurality of support mount brackets or assemblies as well as the longitudinal spacing of the platform units and the angular orientation of the platform members and the upper wall surfaces shown and defined by the rollers. The assembly thus provides a very versatile unit which can be mounted to any one of a plurality of different watercraft structures. Similarly, the support members are shown as square tubular members but may be readily formed of round tubing, other rigid elongated members or the like with or without lateral interconnection between the spaced members to provide further structural support if deemed necessary or desirable. Thus, the design of the understructure may be any support structure sufficient to support the platform structure, and may even be formed as a support structure attached to the upper portion of the transom.

Further, although shown attached parallel to the transom as considered the most advantageous and practical arrangement, the platform assembly may be attached perpendicular to the transom, and within the very broadest application to the side of the large watercraft.

Further, although described with a particular manual placement for final loading orientation and for unloading, various power systems or other assist systems can be readily applied, with a resulting appropriate cost factor. For example, a hand operated or powered winch system could be provided either as a standard, or as an auxiliary device, for the loading and unloading of the personal watercraft onto and from the platform. A simple block-and-tackle unit could also be carried as an auxiliary equipment on the main watercraft for manual loading and unloading. The powered or manual assist system would be particularly desirable in the event the propulsion system of the personal watercraft is not operative for any reason.

In FIG. 10, the small personal watercraft is shown coextensive with the platform structure. Where the transom is not substantially longer than the watercraft and platform structure, the platform structure is preferably constructed shorter than preferably 60% of the length of the personal watercraft. In the loaded position, the watercraft is located over the front of the platform. If the deck is to be used with the small watercraft loaded, the watercraft is moved outwardly toward the entrance end but on the platform, to expose the deck, the access ladder and the like.

Although the unit is shown in a fixed assembly and orientation, the platform structure may of course take other forms to facilitate the direct loading and unloading. For example, the total unit could be pivoted to permit the riding of the small watercraft onto the platform with the boat support located such that it would move to the horizontal or raised position as the small personal watercraft rides onto the platform structure. If necessary, the platform can then be locked in position or may be held by the weight of the small watercraft. When it is desired to unload the small watercraft, it could be again manually released or powered means could be applied to position the platform structure from a load and transport position to an unload position. Alternatively, the entrance end of the platform structure may be constructed for fixed or selectively placed in angled orientation for convenient direct entrance of the boat onto the platform structure. These and similar modifications and constructions can be obviously provided by those skilled in the art based on the teaching of the present invention and available technologies, all within the scope of the present invention which is particularly directed to the raised fixed platform structure, which is particularly adapted to self-powered movement of the personal watercraft onto the platform as well as simple powered or manually operated devices for direct transfer of the personal watercraft to and from the fixed supporting platform with respect to the body water.

Various modes of carrying out the invention are contemplated as being within the scope of the following claims particularly pointing out and distinctly claiming the subject matter which is regarded as the invention.

I claim:

1. In combination, a powered small watercraft and a watercraft carrier for holding said powered small watercraft on a large watercraft having a motoring water line, said small watercraft having a rigid hull including a rigid bottom wall, said watercraft carrier comprising a platform unit, a mounting means for securing said platform unit to the exterior of said large watercraft, said platform unit including a substantially fixed horizontal support surface having a substantially horizontal support position above said water line of the large watercraft when the platform units secured to the large watercraft, said small watercraft being supported in a horizontal support position on said support surface, said mounting means preventing immersion of the platform unit and the support surface beneath said water line, said bottom wall of said powered small watercraft directly engaging and resting on said horizontal support surface in said support position, and said platform unit and horizontal support surface having an entrance end, and said mounting means for securing said platform unit adjacent said water line with said support surface out of said water and facilitates the direct receiving and loading said small watercraft with the bottom wall of said small watercraft engaging said entrance end of said horizontal support surface and moving onto said substantially horizontal support surface to the horizontal support position in response to direct powered movement of the small watercraft from the water over said entrance end of said horizontal support surface onto said substantially horizontal support surface.

2. The combination of claim 1, wherein said rigid hull has a rigid inclined forward end projecting upwardly of the waterline of the small watercraft to an upper end and facilitates movement of said small watercraft from the water upwardly at an angle onto said entrance end and then said small watercraft pops upwardly onto said support surface with said support surface held substantially in said support position.

3. A watercraft carrier for holding a powered small watercraft having a rigid wall with spaced outer edges on a large watercraft having a water line, comprising: a platform unit, a mounting means for securing said platform unit to the exterior of said large watercraft and defining a substantially horizontal support surface having a substantially horizontal support position in relation to the water line of the large watercraft, said mounting means includes a separate fixed support structure including a plurality of support units, each of said support unit includes an upper rigid support member having a mount end and an outer end and located in a substantially horizontal plane, a mount unit secured to said mount end and having means for securing the upper rigid support member to said large watercraft, an inclined bottom rigid support member having a mount end and an outer end, a second mount unit secured to said mount end of said bottom rigid support member and having means for securing said bottom rigid support member to said large watercraft, and a connector secured to said outer ends of said upper and bottom rigid support members, said platform unit including at least two laterally spaced and linear platform elements fixedly secured to and located above said upper rigid support members and forming said substantially horizontal support surface, said linear platform elements being located in laterally spaced and parallel alignment in a substantially horizontal plane and spaced inwardly of the outer edges of the bottom wall of said watercraft for supporting the small watercraft, and said linear platform elements having a rigid entrance and aligned with the entrance end of the small watercraft in the water facilitating the direct movement of the small watercraft from the water onto said horizontal support surface.

4. The watercraft carrier of claim 3, wherein each of said linear platform elements includes spaced roller units defining said platform support surfaces.

5. The carrier of claim 4, wherein said each of said roller units is constructed to define a support surface resiliently engaging and supporting said bottom wall to adjust to variations in the bottom wall from the support surface of said rollers.

6. The carrier of claim 5, wherein said rollers are formed of a resilient material to establish said resilient support.

7. The carrier of claim 3, wherein each of said linear elements includes a plurality of spaced roller units having rollers with top surface oriented in accordance with the bottom wall of the small watercraft and forming at least a portion of said support surface.

8. The carrier of claim 7, wherein said spaced rollers are constructed to define a support surface resiliently engaging and supporting said bottom wall to adjust to variations in the bottom wall from the support surface of said rollers.

9. The carrier of claim 8, wherein said rollers are formed of a resilient material to establish said resilient support.

10. A watercraft carrier apparatus in combination with a powered small watercraft for supporting the small watercraft on a large watercraft substantially larger than said small watercraft, said large watercraft having a water line, said small watercraft having a rigid hull and a powered engine for propelling the watercraft through the body of water and having a rigid front end wall substantially above said water line and having a bottom wall, said carrier comprising: a support structure including a mount unit for fixed securement to the large watercraft and having at least one support unit connecting to said mount unit and projecting outwardly in a fixed horizontal position from the mount unit and maintained in said horizontal position, and a rigid platform unit fixedly secured to said support unit and located above said water line of the large watercraft when the support structure is secured to the large watercraft and defining a substantially fixed horizontal support surface located above the water line of the large watercraft for holding the powered small watercraft thereon in a horizontal transport position with the bottom wall resting on said rigid platform unit, said fixed horizontal support surface having an entrance end located adjacent said water line when the support structure is secured to the large watercraft, and said small watercraft in said water having said front end wall of the small watercraft engaging said entrance end for self-powered movement of the small watercraft onto said entrance end and substantially onto the fixed horizontal support surface into the horizontal transport position for supporting the small watercraft in a horizontal position above said water line of said large watercraft.

11. The watercraft carrier platform apparatus of claim 10, wherein said support structure includes a plurality of said support units, each of said support units including an elongated top member having a upper mount end and an outer end, said top member being located in a substantially horizontal plane and being a rigid tubular member, said mount unit including upper mount members secured one to each said upper mount end and thereby to said large watercraft, each of said support units including an inclined elongated bottom member, said bottom member being a rigid tubular member having a bottom mount end and an outer end, a common connector secured to the outer ends of said top and bottom members, and said mount unit including bottom mount members connected one each to said outer ends of said bottom members and thereby to said large watercraft.

12. The platform apparatus of claim 11, wherein each of said top and bottom members is a rigid elongated tubular member having a rectangular cross-section, said mount members and connector having U-shaped brackets telescoped over the end of said top and bottom mount members and being secured therein.

13. The platform apparatus of claim 11, wherein said bottom mount members and said common connector include pivot joints for adjusting said bottom rigid member.

14. The watercraft carrier platform apparatus of claim 10, wherein said platform unit includes at least two laterally spaced and linear platform members defining said support surface, said platform members being located in laterally spaced and parallel alignment and adapted to engage the bottom wall of said small watercraft with the small watercraft on said platform unit for supporting said small watercraft on said large watercraft.

15. The platform apparatus of claim 14, wherein each of said platform members includes a rigid elongated support member and spaced roller units secured to said elongated support member defining said support surface.

16. The platform apparatus of claim 15, wherein said roller units includes end roller units secured to opposite ends of said elongated support members, said support members being tubular members having an open top, each end roller unit includes an axle supported in said tubular member and projecting outwardly of the tubular member, each said end roller unit including a central roller journaled on said axle and located within said opening with the roller surface projecting outwardly of the tubular member, and having end rollers journaled on the outer ends of said axle with outer surfaces aligned with the central roller.

17. The platform apparatus of claim 16, wherein said plurality of roller units further includes a plurality of central roller units longitudinally spaced between said end roller units, said plurality of central rollers units being mounted on individual axles on said tubular member.

18. The platform apparatus of claim 11, wherein the large watercraft has a substantially vertical transom, each of said mount members includes a U-shaped metal bracket having a flat back wall and spaced vertical sidewalls telescoped over said respective top and bottom members, said top and bottom members being tubular members with a rectangular cross-section corresponding to the spacing of said vertical sidewalls.

19. In combination, a small watercraft, a large watercraft having a transom with an angular orientation to a vertical plane and having a waterline, said large watercraft having a carrier unit for supporting said small watercraft, said small watercraft having a rigid hull and a propulsion system for moving the small watercraft over a body of water; said carrier unit comprising a mount unit secured to said transom, a support structure secured to said mount unit and projecting rearwardly from said transom for supporting said small watercraft in a horizontal supported transport position on said large watercraft, a small watercraft platform secured in a fixed relationship to said support structure and having a substantially fixed platform surface extended substantially horizontal from and parallel to said transom and on which said small watercraft directly rests in the transport position, said platform surface located above said waterline and having an entrance end adjacent said waterline and facilitating movement of said small watercraft moving over said water directly onto said platform surface and then popping upwardly out of the water and onto said substantially fixed platform surface into the horizontally supported transport position under the propulsion power of the small watercraft.

20. The watercraft of claim 19, wherein said small watercraft includes a rigid bottom wall and said platform unit includes at least two laterally spaced and linear platform elements defining said platform surface, said elements being located in laterally spaced and parallel alignment in accordance with the bottom wall of said small watercraft.

21. The watercraft of claim 20, wherein each of said platform elements includes spaced roller units defining the platform surface.

22. The watercraft of claim 19, wherein said support structure includes a plurality of support units, each of said units including a top rigid rod having a mount end and an outer end and located in a substantially horizontal plane, a mount unit secured to said mount end and to said watercraft, an inclined bottom rigid rod having a mount end and an outer end, a pivotal mount unit secured to said mount end and to said watercraft and having a pivot joint permitting pivoting of the bottom rigid rod, and a common pivotal connector secured to said outer end of said rigid rod and said inclined rod.

23. The method of releasably supporting a small powered watercraft on a large watercraft moving through a body of water and said large watercraft having a water line, comprising providing the large watercraft with a platform unit secured to the large watercraft, said platform unit having a horizontal support surface having a horizontal support position located slightly above said waterline and located for movement of the large watercraft through the body of water in said support position, providing a small watercraft having a hull with a front inclined end and a propulsion unit for moving the small watercraft through a water body, said small watercraft having a length generally corresponding to said support surface, and further comprising the steps of powering said propulsion unit and establishing powered movement over the water and into the entrance end of said horizontal support surface and loading said small watercraft onto said support surface by maintaining said powered movement of the small watercraft through the water body with the front end moving onto and upwardly on said entrance end of said platform unit at least until the small watercraft is located forwardly on said platform unit such that the watercraft drops into a horizontally supported position on said support surface and thereby locating said small watercraft in a substantially horizontal position for transport on said large watercraft.

24. The method of claim 23, wherein said moving of the small watercraft includes self-propulsion of the small watercraft through the body with the front end moving onto and upwardly of said entrance end of said platform unit with said support surface in said horizontal support position and then increasing the propulsion force for popping the small watercraft upwardly onto said support surface of the platform to support said small powered watercraft on said platform unit.

25. The method of claim 24, including moving the powered small watercraft from said platform unit by the step of pushing the small watercraft from the platform into the water body for separate use of said powered small watercraft.

26. The method of claim 24, wherein said large watercraft has a rear transom and including providing said platform unit with a support surface extending parallel to and adjacent the transom of said large watercraft and locating said entrance end substantially aligned to one side of said large watercraft.

27. The method of claim 23, including providing the platform with roller units defining said support surface to minimize the frictional characteristic of said support surface.

* * * * *

UNITED STATES PATENT AND TRADEMARK OFFICE

CERTIFICATE OF CORRECTION

PATENT NO. : 5,636,587

DATED : June 10, 1997

INVENTOR(S) : JEROME R. KLIMOWICZ

It is certified that error appears in the above-identified patent and that said Letters Patent is hereby corrected as shown below:

Column 10, line 49, CLAIM 3, between "entrance" and "aligned" delete "and" and substitute therefore ---end---

Signed and Sealed this

Tenth Day of February, 1998

*Attest:*

Bruce Lehman

BRUCE LEHMAN

*Attesting Officer*

*Commissioner of Patents and Trademarks*